US006210564B1

(12) United States Patent
Brons et al.

(10) Patent No.: US 6,210,564 B1
(45) Date of Patent: Apr. 3, 2001

(54) PROCESS FOR DESULFURIZATION OF PETROLEUM FEEDS UTILIZING SODIUM METAL

(75) Inventors: Glen Brons, Phillipsburg, NJ (US); Ronald Damian Myers, Calgary (CA); Roby Bearden, Jr., Baton Rouge, LA (US); John Brenton MacLeod, Calgary (CA)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 08/864,704

(22) Filed: May 28, 1997

Related U.S. Application Data

(63) Continuation-in-part of application No. 08/659,130, filed on Jun. 4, 1996, now abandoned.

(51) Int. Cl.[7] ..... C10G 45/02; C10G 29/04

(52) U.S. Cl. ..... 208/208 M; 208/208 R; 208/209; 208/294

(58) Field of Search ..... 208/208 M, 208 R, 208/209, 294

(56) References Cited

U.S. PATENT DOCUMENTS

| | | | | |
|---|---|---|---|---|
| 1,938,671 | * | 12/1933 | Sullivan, Jr. et al. | 208/208 M |
| 1,938,672 | * | 12/1933 | Ruthruff | 208/208 M |
| 2,927,074 | * | 3/1960 | Barger, Jr. et al. | 208/208 M |
| 3,004,912 | * | 10/1961 | Kaneko et al. | 208/208 M |
| 3,755,149 | * | 8/1973 | Kohn | 208/208 M |
| 3,785,965 | | 1/1974 | Welty, Jr. | 208/208 M |
| 3,787,315 | | 1/1974 | Bearden, Jr. et al. | 208/208 M |
| 3,788,978 | | 1/1974 | Bearden, Jr. et al. | 208/208 M |
| 3,791,966 | | 2/1974 | Bearden, Jr. | 208/208 M |
| 4,003,824 | | 1/1977 | Baird, Jr. et al. | 208/108 |
| 4,076,613 | | 2/1978 | Bearden, Jr. | 208/108 |

FOREIGN PATENT DOCUMENTS

3429966 * 2/1986 (DE) .

OTHER PUBLICATIONS

Kalichevsky and Kobe, *Petroleum Refining With Chemicals*, Ch. 4, Elsevier Publishing (1956).

* cited by examiner

*Primary Examiner*—Walter D. Griffin
(74) *Attorney, Agent, or Firm*—Linda M. Scuorzo

(57) ABSTRACT

Sulfur-containing petroleum feeds are desulfurized by contacting the feeds with staged addition of sodium metal at temperatures of at least about 250° C. in the presence of excess hydrogen to sodium metal. The formation of $Na_2S$ is substantially suppressed and the formation of NaSH is promoted in the desulfurization process.

9 Claims, 1 Drawing Sheet

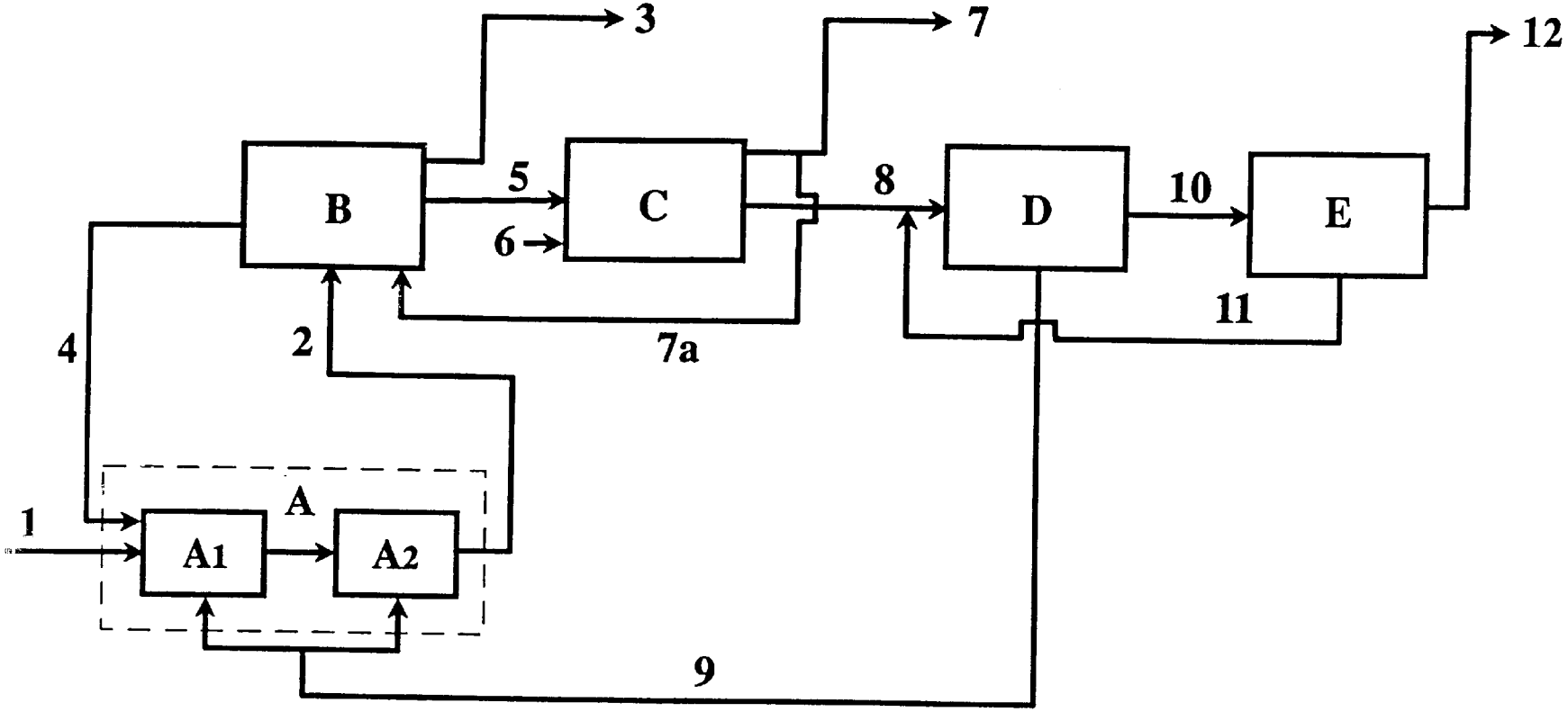
12
E
11
10
D
7
8
C
7a
3
5
6
9
B
2
A
A2
A1
4
1

PROCESS FOR DESULFURIZATION OF PETROLEUM FEEDS UTILIZING SODIUM METAL

This application is a continuation-in-part of U.S. Ser. No. 659,130 filed Jun. 4, 1996, now abandoned.

FIELD OF THE INVENTION

The invention relates to a process for desulfurizing petroleum feeds.

BACKGROUND OF THE INVENTION

Petroleum feeds such as residuum feeds, particularly bitumen (heavy oil), are laden with high levels of heteroatoms (nitrogen, oxygen and sulfur) and metals (nickel, vanadium and iron). Petroleum feeds such as naphtha and distillate fractions also can contain undesirable levels of such heteroatoms. With environmental constraints continually lowering the allowable amounts of sulfur in such oils, economical processes are necessary to refine or upgrade the oils into acceptable products.

Heavy oils have been desulfurized in prior art processes using metallic sodium via the following route. Disadvantageously many steps are then needed to separate the product oil and to regenerate the metallic sodium.

$$R'—S—R+2Na+H_2 \rightarrow R—H+R'—H+Na_2S \quad (1)$$

Thus in these processes the desulfurization reaction requires one mole of hydrogen and two moles of sodium per mole of sulfur removed, one mole to form a sodium mercaptide salt intermediate ($R—S^-Na+$, where R represents an organic moiety in the oil) and the second mole of sodium to remove the sulfur from the oil by and forming sodium sulfur ($Na_2S$). The $Na_2S$ byproduct has a melting point of about 1,180° C. To facilitate recovery of the $Na_2S$ using liquid—liquid separation, the salt is converted to the more easily separated sodium hydrosulfide (NaSH, melting point of 350° C.) by treating with hydrogen sulfide ($H_2S$) in a subsequent quench step. For regeneration of the metallic sodium, the NaSH is first treated with elemental sulfur to generate sodium tetrasulfide ($Na_2S_4$) and $H_2$ byproduct. The $Na_2S_4$ is then processed through an electrolytic cell to generate Na and sodium pentasulfide ($Na_2S_5$). The pentasulfide can then be pyrolyzed to yield the tetrasulfide (which can be recycled to the electrolytic cell) and elemental sulfur. The many separate steps of the prior art processes are lengthy, time consuming and costly.

How efficiently the sodium functions in the above described system to remove organically bound sulfur from oils is measured by "Na Efficiency". This value represents the efficiency of the charged sodium in desulfurizing the oil relative to forming $Na_2S$, wherein the second mole of Na cleaves the $R—S^-Na+$ salt intermediate to form the $Na_2S$ product. The equation for determining % Na Efficiency is as follows:

$$\%\ \text{Na Efficiency} = \frac{\text{Theoretical Na/S Ratio } (=2.0)}{\text{Actual Na/S Ratio}} \times \%\ \text{Desulfurization} \quad (1)$$

Sodium metal desulfurization is disclosed in U.S. Pat. Nos. 3,785,965; 3,787,315; 3,788,978; 3,791,966; 3,796,559; 4,076,613 and 4,003,824. This earlier art describes the addition of hydrogen solely for capping the R• radicals formed and the prevention of retrograde condensation reactions. The latter of which reduce yield and oil quality. In the prior art, 438° C. temperatures are described for as much as 60 minutes treatment time and hydrogen was used. In these prior art, sodium efficiencies of 60–80% are typically achieved.

Sulfur laden petroleum feeds, such as heavy oils, including bitumen, have been desulfurized by treatment with sodium metal and small amounts of hydrogen. This process is not commercialized today because regeneration of the sodium metal is costly. What is needed is an economical method for desulfurizing petroleum feeds. The process of this invention provides this benefit.

BRIEF DESCRIPTION OF THE DRAWING

The FIGURE schematically describes an embodiment of the process for desulfurizing a petroleum feed.

SUMMARY OF THE INVENTION

The present invention provides for a process for the desulfurization of sulfur containing heavy oils, comprising contacting said heavy oil using a staged addition of sodium metal at a temperature of at least about 250° C. in the presence of an effective excess of hydrogen to sodium metal to substantially suppress the formation of $Na_2S$ and to promote the formation of NaSH directly. Thus the added hydrogen cleaves the $R—S^-Na+$ intermediate salt instead of reacting with a second mole of Na. Desirably the sodium metal addition to the petroleum feed is controlled to maintain a molar equivalent of Na to S of 1:1.

The present invention may suitably comprise, consist, or consist essentially of the elements described herein and may be practiced in the absence of a limitation not disclosed as required.

DETAILED DESCRIPTION OF THE INVENTION

The present invention provides for a method for enhancing the efficiency of desulfurization of petroleum feeds containing sulfur moieties, including heavy oils (bitumen, atmospheric and vacuum residues), light crude oils such as naphtha fractions (virgin, cracked and hydrotreated naphthas), distillate fractions and vacuum gas oils with sodium metal. The process is carried out by staged addition of metallic sodium in the presence of an effective excess of hydrogen in the petroleum feed. Sodium efficiencies of at least 100%, preferably at least 150% can be achieved. The "sodium efficiency" value represents the efficiency of the charged sodium in desulfurizing the feed relative to forming $Na_2S$, the by-product from the desulfurization using Na to cleave the initial mercaptide salt. The equation for determining % Na efficiency is shown below.

$$\%\ \text{Na Efficiency} = \frac{\text{Theoretical Na/S Ratio } (=2.0)}{\text{Actual Na/S Ratio}} \times \%\ \text{Desulfurization} \quad (2)$$

Typically, the efficiency of prior art processes for sulfur removal from heavy feeds falls in the range of 60–80%. By controlling, i.e., staged addition of effective amount of sodium metal so that the molar equivalent of Na to unreacted, organically-bound sulfur is 1:1 and $H_2$ to S is at least 1.5:1 on a stoichiometric basis, the formation of sodium mercaptide salts with organic sulfur components in the oil is controlled. Thus only one mole of sodium is utilized per mole of sulfur removed from said petroleum feed. The reaction in the presence of an effective excess hydrogen can proceed to the formation of sodium hydrosulfide substantially eliminating the formation of sodium sulfide. The sodium hydrosulfide can then be removed from the treated feed using a two phase liquid—liquid separation of the molten salt at temperatures of about 350° C. The sodium is maintained in a liquid or molten state during addition to the petroleum feed.

Applicants have discovered that the addition of effective amounts of hydrogen, desirably in a ratio of $H_2$ to S of at least 1.5:1, preferably at least 2:1, more preferably at least 3:1 or greater, during sodium metal desulfurization in combination with at least one staged addition of the amount of sodium decreases the required amount of sodium metal used as compared to current processes by half and also eliminates the need for a step involving $H_2S$ quenching of sodium sulfide because sodium hydrosulfide is formed directly. After separation from the oil, the hydrosulfide is then reacted with additional elemental sulfur to form sodium polysulfide which can be converted back to sodium metal. Thus, by eliminating half the amount of sodium metal, the process also effectively eliminates the need for half the number of costly electrolytic cells to regenerate the sodium metal with a potentially significant cost reduction for the process.

The feeds that are applicable to treatment with sodium in accordance with this invention include any organic sulfur containing petroleum feeds and fractions, such as heavy oils, atmospheric residua, vacuum residua, and bitumen; light crude oils, e.g., as naphtha fractions (virgin, cracked and hydrotreated naphthas); distillate fractions and vacuum gas oils. For example, bitumen and heavy oils having a substantial fraction, e.g., greater than 50% boiling in excess of 565° C. (1050° F.) can be treated. Treatment of such petroleum feeds with metallic sodium according to the process of the present invention can result in removal of sulfur from the feeds to greater than 95%, preferably essentially complete removal. With heavier feeds, i.e., petroleum residua and heavy crudes, conversion of the 565° C. (1,050+° F.) bottoms to distillable oils can be at least about 30%.

Current (prior art) processes require at least two molar equivalents of sodium per mole of sulfur in the oil to form sodium sulfide ($Na_2S$). For example, in typical prior art processes for the desulfurization of heavy feeds (e.g., U.S. Pat. No. 3,788,978), the mole ratio of sodium to sulfur that is required is above 2.0, ranging up to as high as 2.5. The sodium sulfide that is produced in the prior art processes cited forms a highly dispersed microcrystalline solid which has a melting point of about 1180° C. It is difficult to handle in an anhydrous environment and remains a solid dispersed in the treated product. To recover the sodium sulfide, current processes employ a quench step using hydrogen sulfide to convert the sodium sulfide to sodium hydrosulfide (NaHS). The sodium hydrosulfide can then be removed as a molten salt at lower temperatures (melting point of about 350° C.). Finally, the sodium hydrosulfide then typically is treated with 3 moles of elemental sulfur to form sodium tetrasulfide ($Na_2S_4$) which can be reconverted to sodium metal via electrolytic cells.

$$Na_2S+H_2S \rightarrow 2NaHS \text{ (molten salt)} \quad (3)$$

$$2NaHS+3S \rightarrow Na_2S_4+H_2S \quad (4)$$

Applicants believe that in the prior art processes organic sodium sulfide salt, a sodium mercaptide ($R—S^-Na^+$ wherein R is the organic substrate in the oil or other petroleum feed) is formed during the chemical attack of sodium on the carbon sulfur bond of the organic substrate in the oil or other petroleum feed. In Applicants' staged sodium addition process, hydrogen is maintained in effective excess relative to sodium in the reaction zone, to preferentially result in the reaction of hydrogen with the sodium mercaptide intermediate to form sodium hydrosulfide (NaHS). Aside from reducing the amount of sodium required, the direct formation of sodium hydrosulfide will reduce or eliminate the use of hydrogen sulfide in the salt recovery step of the process. Moreover, reduction of the amount of sodium required in this cyclic sodium treating process will reduce the size of the sodium regeneration facility, thus reducing the overall investment and operating costs of the process.

The process of controlled sodium treating according to the present invention is further illustrated using bitumen as an example of R—S—R' with the following equations:

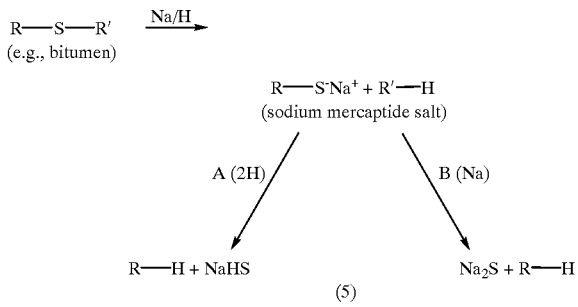

(5)

wherein R and R' represent organic in the oil, or other sulfur containing petroleum feedstock.

The present invention uses staged sodium addition to control the amount of sodium available to react while and maintaining an excess of hydrogen relative to sodium in the reaction zone preferably at least 3:1 H to Na such that reaction A (reaction of sodium mercaptide with hydrogen to form NaSH) is favored over B (reaction with sodium to form $Na_2S$). The potential for enhanced efficiency of sodium utilization for sulfur removal is evident; reaction A requires only one mole of sodium per mole of sulfur, whereas reaction B (the typical path of prior art processes) requires two moles of sodium per mole of sulfur.

Sodium staged addition to the reaction zone can be accomplished in several ways. In batch reactor tests, at least two methods may be used: (a) all of the sodium can be added initially with the petroleum feed and the rate of stirring can be used to control the rate at which sodium is dispersed into the oil phase to achieve the required ratio of Na to S, and in a preferred method (b) sodium can be staged into the reactor over the course of a reaction period. For continuous flow operation, two or more reactors in a series would be used in the reaction zone with sodium added to each reactor to maintain the proper ratio (The FIGURE).

In another embodiment, sodium is injected at various points along a vertical reactor. In general, any configuration can be used that provides the desired ratio of metallic sodium to unreacted, organically bound sulfur at 1: 1.

Advantageously, the instant process also removes other contaminants in addition to sulfur, such as nickel and vanadium. The viscosity and density of the oil are also improved.

Contacting of the reactants should be at conditions of temperature, pressure and residence time sufficient to minimize or preferably result in the essential absence of $Na_2S$ formation and to maximize NaHS formation and to maintain the Na metal in a liquid or molten state. Excess hydrogen (pressure, concentration) is defined as an amount above that required by the art (about 200 psig, 1378.8 kPa) that is effective to minimize the amount of Na metal consumed to about one equivalent (molar) based on the amount of sulfur present in the petroleum feed. This is in contrast to about two equivalents typically required in the art and to the fact that $Na_2S$ forms in current processes. The temperatures under which the desulfurization step may be carried out include 250° C. to 500° C., preferably 325° C. to 400° C. Higher hydrogen pressures are important and preferably hydrogen of at least about 300 psig (2,068 kPa) to over 1000 psig (6,894 kPa) at reaction temperature, more preferably at least about 400 psig (2,758 kPa), up to about 1,000 psig (6,894 kPa) and most preferably 400 psig (2,758 kPa) to about 800 psig (5,516 kPa) is used.

In carrying out this process, excess hydrogen is employed in combination with the effective amount of Na to promote the formation of NaHS in preference to $Na_2S$. The amount of $H_2$ to S on a molar basis to sulfur should be at least 1.5 (3H: 1S or Na), preferably at least 3:1 and more preferably up to about 5:1 depending upon the constraints of the reaction system. Higher hydrogen pressures would be more advantageous.

Controlled addition of Na is accomplished by staged addition of the sodium in at least a 1:1 molar equivalent, preferably a 1:1 ratio of Na to S. Additionally, more reactors (in series), e.g., at least two, a plurality may be used into each of which the Na may be staged in. Each reactor would use at least 0.010:1 to 1:1 Na to unreacted sulfur and at least 0.015:1 to 1.5:1 $H_2$ to unreacted sulfur depending on the number of reactors used in the series of reactors. Temperature and pressure requirements remain the same as those used in the single reactor using staged Na addition. Thus the present invention may be practiced in a batch or continuous process by suitable combination use of multiple staged addition of Na and/or multiple reactors in series. The important aspect of the process being that the amount of liquid or molten Na effective to enhance NaHS formation and to minimize $Na_2S$ formation is added to the(se) reactor(s) at a given time.

For application of the sodium desulfurization process of the present invention to lower sulfur (<2,000 wppm) containing feeds (e.g., naphthas, distillate fractions), the sodium regeneration may not be economic and/or required. Therefore, a once-through process may be utilized. Here also, the preferred formation of the NaSH over the $Na_2S$ allows for easier separation of the salt byproduct.

The remaining features of the process, the quench, conversion of NaHS to a sodium polysulfide and electrolytic regeneration of sodium may be carried out as known in the art.

FIG. 1 presents a non-limiting embodiment of the present invention using staged addition of sodium metal and excess hydrogen. Therein, a petroleum feed stream and hydrogen enter reaction zone (A) through line (1), the zone comprising two or more reactors in series ($A_1$, $A_2$, etc.). Molten sodium is injected into each reactor to effect staged sodium addition. The reactor effluent, which comprises desulfurized oil and desulfurization salts, is fed to separator (B) through line (2), where molten sodium hydrosulfide (and demetallization products) are separated from the desulfurized oil. A small amount of hydrogen sulfide may be added to (B) at (7*a*) to ensure that any $Na_2S$ formed in the reaction zone is converted to NaSH. Desulfurized product oil is removed through line (3), excess hydrogen is returned to (A) through line (4) and molten sodium hydrosulfide is passed to reactor (C) through line (5). Elemental sulfur is added at (6) to convert sodium hydrosulfide to sodium tetrasulfide and hydrogen sulfide. The gaseous hydrogen sulfide is removed via line (7) and at least a portion may be recycled to reactor (C) through (7*a*). Excess hydrogen sulfide may be sent to a Claus plant for recovery of sulfur. Molten sodium tetrasulfide is passed to an electrolytic sodium-sulfur cell (D) by (8) to regenerate the sodium metal, which is recycled to reactor (A) via (9). See U.S. Pat. No. 3,787,315 for a representative description of the electrolytic cell. Sodium polysulfide exiting cell (D), is enriched in sulfur (e.g., may comprise $Na_2S_5$) and is sent to pyrolysis zone (E) at (10) to recover an elemental sulfur stream and a sulfur depleted polysulfide that is recycled to electrolytic cell (D) at (11). Buildup of feed-derived metals in the cell feed is controlled by removing an appropriate purge stream from the cell feed at (12).

The prior art includes a hydrogen sulfide quench step after the reactor (A) and before the separator (B) because $Na_2S$ is formed in that process. This quench step is used to convert the $Na_2S$ to NaHS, which can be separated more easily than the $Na_2S$. The slow release of Na (or staged addition), as in the instant procedure, allows for the formation of NaHS directly and, as such, reduces or eliminates the $H_2S$ quench step.

The examples below are illustrative of the invention and are not meant to be limiting.

EXAMPLES

The following examples illustrate that staged addition of sodium in the presence of excess hydrogen greatly reduces the amount of sodium needed to attain a given level of desulfurization, i.e., the efficiency of sodium treating is improved.

The first three attempts to increase the % Na efficiency by using hydrogen to cleave the initial mercaptide salt, are given in Tables 1 and 2, Treatments 1, 2 and 3. Each treatment charged Na at Na/S ratios between 1.13 and 1.25, allowing enough Na only to form the initial salt. In these examples, all of the Na was charged at the start of the reaction. Reduced stir rates were used to allow for the slow release of the Na into the oil facilitating staged addition of Na mechanically to afford time for the hydrogen to cleave the salt. Treatment 1 shows that with a stir rate of 800 rpm, the Na efficiency was 88%. Treatments 2 and 3, which were carried out using slower stir rates, 230 and 300 rpm, respectively, attained Na efficiencies over 120%. This illustrates that less than two moles of sodium were required to desulfurize the feed stock, and that NaHS was formed.

The last example, Treatment 4 (Tables 1 and 2), illustrates the effect of charging the sodium via direct staged addition by adding Na over time to a stirred reactor. This treatment better allows for slower release of sodium or the hydrogen or both in the system to cleave more effectively the initially formed mercaptide salt. The data show that the Na efficiency is nearly 190%. This staged addition approach is a more efficient means of practicing the instant procedure than slowed stir rates (<1,000 rpm). Ideal Na release conditions would result in a Na efficiency of 200%. The near 190% Na efficiency demonstrates that NaHS is formed via the instant procedure and $Na_2S$ is not formed.

TABLE 1

Sodium Desulfurization Treatment on Athabasca Bitumen - Treatment Conditions

| | Treatment | | | |
|---|---|---|---|---|
| | 1 | 2 | 3 | 4 |
| Na Charge[a] | Full | Full | Full | Staged (0.5 cc/min) |
| $H_2$ (cold charge, psig)[b] | 470 | 758 | 600 | 500 |
| Temp. (avg., ° C.) | 307 | 390 | 389 | 374 |
| Temp. (max., ° C.) | 334 | 428 | 407 | 390 |
| Time (at $T_{avg.}$, mins.) | 10 | 20 | 37 | 20 |
| Initial Stir Rate (rpm)[c] | 800 | 230 | 300 | 2,000 |
| Bitumen Charge | | | | |
| Weight (grams) | 200 | 200 | 228 | 225 |
| Sulfur (mmol) | 320 | 320 | 320 | 360 |
| Water (mmol) | 111 | 111 | 127 | 125 |
| Sodium Charge | | | | |
| Weight (grams) | 10.9 | 11.0 | 13.4 | 7.38 |
| mmol | 474 | 478 | 583 | 321 |
| Molar Na/S Ratio (water-free basis) | 1.13 | 1.15 | 1.25 | 0.544 |
| Molar $H_2$/S Ratio | 3.2 | 5.2 | 4.0 | 3.0 |

[a]"Full" Na charge - all of the Na is charged initially into the reactor before heating. "Staged" Na charge - Na is added after heating at the rate given (cc/min.).
[b]3241; 5226; 4137; 3448 kPa, respectively.
[c]All final stir rates brought up to 2,000 rpm's.

TABLE 2

Product Qualities from Sodium Desulfurization Treatment on Athabasca Bitumen

| | Treatment | | | | |
|---|---|---|---|---|---|
| Product Quality | Untreated[1] | 1 | 2 | 3 | 4 |
| Wt % Water | 1.0 | — | — | — | — |
| Wt % Sulfur | 5.12 | 2.57 | 1.55 | 1.07 | 1.53 |
| Metals (ppm) | | | | | |
| Nickel | 80 | 68 | 52 | | 14 |
| Vanadium | 213 | 108 | 55 | | 25 |
| Density (15° C., grams/cc) | 1.024 | 0.987 | 0.968 | 0.927 | 0.975 |
| Viscosity (20°, cP) | >500,000 | 43,500 | 1,400 | 17 | 43 |
| % Desulfurization | — | 49.8 | 69.7 | 79.1 | 50.6 |
| % Na Efficiency | — | 88.1 | 121 | 127 | 186 |

[1]Untreated oil contains approximately 1.0 wt % water.

Hydrogenolysis treatments of a model sodium mercaptide compound salt (sodium thiophenolate, or thiophenol sodium salt, $C_6H_5$—$S^-Na^+$) with hydrogen at temperatures and pressures used under typical sodium metal desulfurization conditions were carried out. The experimental parameters and conditions are provided in Table 3. The following reaction should occur:

$$C_6H_5—S^{-Na^+}+H_2 \rightarrow C_6H_6+NaSH$$

The only differences between these two experiments (Table 3) were the treatment temperatures and the initial hydrogen charges. The results indicate that the less severe conditions yield the same results.

The product NaSH is isolated as a solid. Assuming 100% conversion of the 25.0 grams of the sodium thiophenolate charges, the theoretical weight of the recovered NaSH should be 10.6 grams. The data show that greater than 97% conversion occurs. Also, the solids contained up to 53 wt % sulfur, which is almost exactly that of pure NaSH (57 wt % sulfur). Note that the sodium thiophenolate is only 24 wt % sulfur.

Both of the product organic layers collected from each experiment were examined by gas chromatographic separation followed by mass spectroscopy (GC/MS) and found to contain only solvent (1-methyl naphthalene) and the product benzene.

These results, combined with the earlier studies on whole bitumen, clearly demonstrate that the addition of excess hydrogen assists in the removal of sulfur from petroleum feeds.

TABLE 3

Hydrogenolysis of Sodium Thiophenolate

| | Treatment A | Treatment B |
|---|---|---|
| Temperature, ° C. | 430 | 411 |
| Initial $H_2$ charge psig/kPa | 750/5170 | 400/2760 |
| Sodium thiophenolate (grams) | 25.0 | 25.0 |
| Solvent (1-methyl naphthalene, grams) | 150.0 | 150.0 |
| P (at $T_{max}$, psig) | 1450 | 860 |
| Product solids (NaSH) | | |
| Recovery Weight (grams) | 9.42 | 10.34 |
| Wt % Sulfur | 53 | 51 |
| Primary product in solvent | benzene | benzene |

What is claimed is:

1. A process for the desulfurization of a sulfur-containing petroleum feed, comprising: contacting said petroleum feed with sodium metal using staged addition at a temperature of from 325° to 400° C. in the presence of an effective molar excess of hydrogen to sodium metal of at least 1.5:1 and at a molar ratio of sodium metal to unreacted sulfur of up to 1:1 to substantially suppress the formation of $Na_2S$ and to promote the formation of NaSH during said desulfurization.

2. The process according to claim 1 wherein said petroleum feed is selected from the group consisting of heavy oil, naphtha and distillate fractions.

3. The process of claim 1 wherein one molar equivalent of sodium metal is consumed per equivalent of sulfur removed from said petroleum feed.

4. The process of claim 1 wherein the hydrogen pressure is from about 2,000 kPa to about 7,000 kPa.

5. The process of claim 1 wherein the sodium efficiency is at least 100%.

6. The process of claim 1 wherein the sulfur removed from the petroleum feed is recovered as NaHS.

7. The process of claim 1 wherein the contacting is carried out in at least two reactors in-series.

8. The process of claim 1 wherein the contacting is carried out in one reactor.

9. The process of claim 1 wherein the petroleum feed contains less than 2000 wppm sulfur.

* * * * *